US005546061A

United States Patent [19]

Okabayashi et al.

[11] Patent Number: 5,546,061

[45] Date of Patent: Aug. 13, 1996

[54] PLUNGER TYPE ELECTROMAGNETIC RELAY WITH ARC EXTINGUISHING STRUCTURE

[75] Inventors: Athuo Okabayashi, Toyota; Kimikazu Nakamura, Kariya; Toshihiko Sugiura, Anjo, all of Japan

[73] Assignee: Nippondenso Co., Ltd., Kariya, Japan

[21] Appl. No.: 393,314

[22] Filed: Feb. 22, 1995

[30] Foreign Application Priority Data

Feb. 22, 1994 [JP] Japan ..... 6-024010

[51] Int. Cl.[6] ..... H01H 51/22

[52] U.S. Cl. ..... 335/78; 335/126

[58] Field of Search ..... 335/126, 131, 335/78–86, 128, 124, 131

[56] References Cited

U.S. PATENT DOCUMENTS 4,367,448 1/1983 Nishizako .
5,132,653 6/1992 Nakatake et al. ..... 335/202
5,394,128 2/1995 Perreira et al. ..... 335/126

FOREIGN PATENT DOCUMENTS 57-13627 1/1982 Japan .
59-14219 1/1984 Japan .
61-271719 12/1986 Japan .
145688 10/1989 Japan .

*Primary Examiner*—Lincoln Donovan
*Attorney, Agent, or Firm*—Cushman Darby & Cushman, L.L.P.

[57] ABSTRACT

An electromagnetic relay is provided which features an arc-extinguishing structure. This electromagnetic relay includes a pair of permanent magnets which are so arranged as to have their magnetic poles oriented diametrically opposite each other across a pair of movable contacts and a pair of stationary contacts for biasing electric arcs produced between the movable and stationary contacts into given spaces defined in a relay housing.

27 Claims, 5 Drawing Sheets

PLUNGER TYPE ELECTROMAGNETIC RELAY WITH ARC EXTINGUISHING STRUCTURE

BACKGROUND OF THE INVENTION

1. Technical Field of the Invention

The present invention relates generally to an electromagnetic relay, and more particularly to an improved arc-extinguishing structure of an electromagnetic relay which is designed to bias an electric arc produced in a contact gap into a given space defined in a relay housing.

2. Background Art

A plunger type electromagnetic relay is known in the art wherein a pair of movable contacts is moved by a common movable contact retainer according to linear displacement of a plunger of a solenoid assembly.

Japanese Patent First Publication No. 59-14219, filed on Jul. 16, 1982, teaches, in FIGS. 3 and 4, an arc-extinguishing structure of a plunger type electromagnetic relay having permanent magnets and pairs of magnetic metal strips. The permanent magnets are mounted, opposite a contact gap across movable contact retainers, perpendicular to a center line of the relay in a direction offset from the center line. The pairs of the magnetic metal strips are attached to both ends of the permanent magnets, respectively, to work as magnetic poles for producing an arc-extinguishing magnetic field across the contact gap.

The above publication further discloses, in FIGS. 6 and 7, an alternative arc-extinguishing structure which has permanent magnets, mounted inside movable contact retainers, oriented magnetically in a direction perpendicular to the permanent magnets discussed above for producing an arc-extinguishing magnetic field across a contact gap.

The former structure shown in FIGS. 3 and 4 encounters the drawback in that the permanent magnets need to be fixed outside the movable contact retainers, thus resulting in an increased size of the relay in a lengthwise direction. This will lead to a bulk structure of the relay. Additionally, it is difficult to mount each pair of the magnetic metal strips so as to extend from both sides of the permanent magnet across the movable contact retainer and the contact gap. Usually, such small component parts are difficult to install in a relay housing using screws because it is inconvenient assembling operation in a narrow space. It is also infeasible to bond the magnetic metal strips to, for example, supports extending from an inner wall of a resin-made housing for the inconvenience of assembly and vibration resistance.

It is, therefore, most useful to form metal strip installation cavities in a resin-made housing in dice-casting for ease of securement of the magnetic metal strips. It is, however, difficult to form such cavities in the resin housing, especially, because it becomes difficult to remove the resin housing from a die after casting. Additionally, if the magnetic metal strips are not provided on both sides of the permanent magnets, the magnetic flux of the permanent magnets will partially act on the contact gap, resulting in reduced magnetic field across the contact gap so that an arc cannot be extinguished completely.

Further, the later structure, taught in the above publication, shown in FIGS. 6 and 7 has the permanent magnets inserted into the U-shaped movable contact retainers, respectively. This arrangement, however, assumes a decreased strength of magnetic field equal to that produced by the structure shown in FIGS. 3 and 4 from which the magnetic metal strips are omitted, thus resulting in greatly decreased arc-extinguishing ability.

U.S. Pat. No. 4,367,448 (corresponding to Japanese Patent First Publication No. 1-45688), file on Jun. 26, 1981, to Nishizako, discloses an arc-extinguishing magnetic structure of an electromagnetic contactor which has permanent magnets mounted above outer two of three contact retainers arranged in parallel to extinguish arcs with the magnetic flux produced by the permanent magnets. These permanent magnets are oriented to have opposite magnetic poles face each other to establish a magnetic flux for extinguishing an arc produced in a contact gap formed between central contacts. This arrangement is magnetically identical with that taught in the above discussed publication No. 59-14219, but different therefrom in that magnetic fluxes produced by the two permanent magnets act on one contact only.

SUMMARY OF THE INVENTION

It is therefore a principal object of the present invention to avoid the disadvantages of the prior art.

It is another object of the present invention to provide an electromagnetic relay with a simple arc-extinguishing structure which is designed to bias an electric arc produced in a contact gap into a given space defined in a relay housing.

According to one aspect of the present invention, there is provided an electromagnetic relay which comprises a movable contact retainer having disposed thereon a pair of movable contacts, a stationary contact retainer having disposed thereon a pair of stationary contacts at a given interval away from the movable contacts, a magnetically driving means for selectively driving the stationary contact retainer to bring the stationary contacts into engagement with and disengagement from the movable contacts, and a pair of permanent magnets having magnetic poles oriented opposite each other across the pair of the movable contacts retained on the movable contact retainer.

According to another aspect of the present invention, there is provided an electromagnetic relay which comprises a movable contact retainer having disposed thereon a pair of movable contacts, a stationary contact retainer having disposed thereon a pair of stationary contacts at a given interval away from the movable contacts, a magnetically driving means for selectively driving the stationary contact retainer to bring the stationary contacts into engagement with and disengagement from the movable contacts, and a pair of permanent magnets having magnetic poles oriented, in alignment with a current flow through the movable contact retainer, diametrically opposite each other across the pair of the movable contacts retained on the movable contact retainer.

In the preferred mode of the invention, the magnetically driving means includes a solenoid assembly and a plunger. The plunger is connected to the movable contact retainer. The solenoid assembly is energized to move the plunger to move the movable contacts into engagement with the stationary contacts. A housing is further provided which is connected to the solenoid assembly and defines therein a working chamber within which the movable contact retainer is disposed.

The solenoid assembly includes a magnetic coil wound in the vicinity of an outer peripheral surface of the plunger and a cylindrical yoke, receiving therein the magnetic coil, constituting part of a stationary magnetic circuit of the solenoid assembly.

The working chamber has arc spaces to which electric arcs produced between the movable and stationary contacts are biased by magnetic forces of the permanent magnets, respectively. Each of the .arc spaces is so defined in the housing as to extend over a contact gap in a width direction of the movable contact retainer.

The housing is formed with a resin material in cup-shape and has permanent magnet storage cavities formed in an end surface of a side wall thereof.

The movable contact retainer is formed with a strip member which retains thereon the movable contacts at a given distance away from each other in a lengthwise direction. The movable contact retainer hats side portions curved outward from the movable contacts in a direction away from the stationary contact retainer.

The stationary contact retainer is formed with a strip member which retains thereon the stationary contacts at a given distance away from each other in a lengthwise direction. The stationary contact retainer has side portions curved outward from the stationary contacts in a direction away from the movable contact retainer.

An arc-resistant member is further arranged to receive an electric arc, produced in the contact gap, biased by the magnetic forces of the permanent magnets. The arc-resistant member is made of a ceramic material.

According to a further aspect of the present invention, there is provided an electromagnetic relay which comprises a relay housing, a movable contact retainer having disposed thereon a pair of movable contacts, a stationary contact retainer having disposed thereon a pair of stationary contacts with a given contact gap between itself and the movable contacts, a magnetically driving means for selectively driving the stationary contact retainer to bring the stationary contacts into engagement with and disengagement from the movable contacts, pairs of permanent magnets disposed within the relay housing, each pair being arranged to have magnetic poles, oriented opposite each other across one of contact pairs composed of the movable contacts and the stationary contacts for biasing an electric arc produced in the contact gap in a given direction, and an arc-resistant member provided in the relay housing for cooling an electric arc, produced in the contact gap, biased by the permanent magnets.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
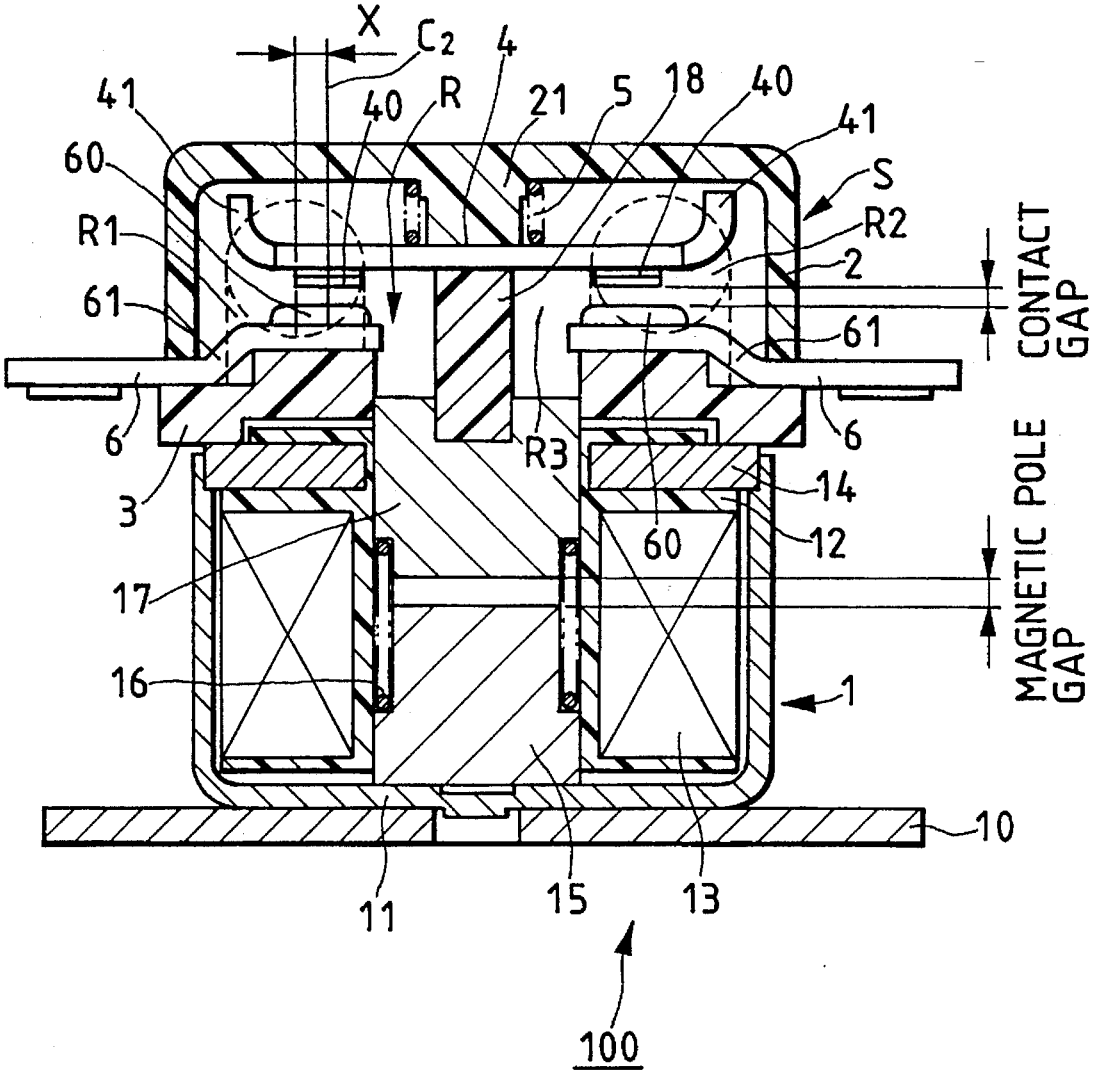
FIG. 1 is a across sectional view which shows a conventional structure of an electromagnetic relay as a comparative example.

Prior to describing an electromagnetic relay of the present invention, a comparative example of a plunger type electromagnetic relay will be discussed below with reference to FIG. 1 to 4.

The plunger type electromagnetic relay 100 generally includes a solenoid assembly 1 and a switching assembly S mounted on the solenoid assembly.

The solenoid assembly 1 includes a cup-shaped frame or yoke 11 and an electromagnetic coil 13. The yoke 11 has a bracket 10 attached to its bottom for mount on an electric automobile, for example. The coil 13 is wound around a bobbin 12 disposed coaxially within the yoke 11.

An annular plate 14 made of magnetic material is fitted into an opening end of the yoke 11 and staked on an upper end of the bobbin 12 coaxially therewith. A stationary cylindrical core 15 made of magnetic material is inserted into the bobbin 12 in engagement with the bottom of the yoke 11. A cylindrical magnetic plunger 17 functioning as an armature is also inserted into the bobbin 12 above the core 15.

Interposed between bobbin 12 and the peripheral surface of the stationary core 15 is a return spring 16 which is mounted in shoulder portions formed on an upper end portion of the stationary core 15 and a lower end portion of the plunger 17. The return spring 16 urges the plunger upward, as viewed in the drawing. An insulating bush 18 made of a resin bar is so fitted into a recessed portion formed in a central portion of the upper surface of the plunger 17 as to extend vertically along the center line of the relay 100.

Figure 2:
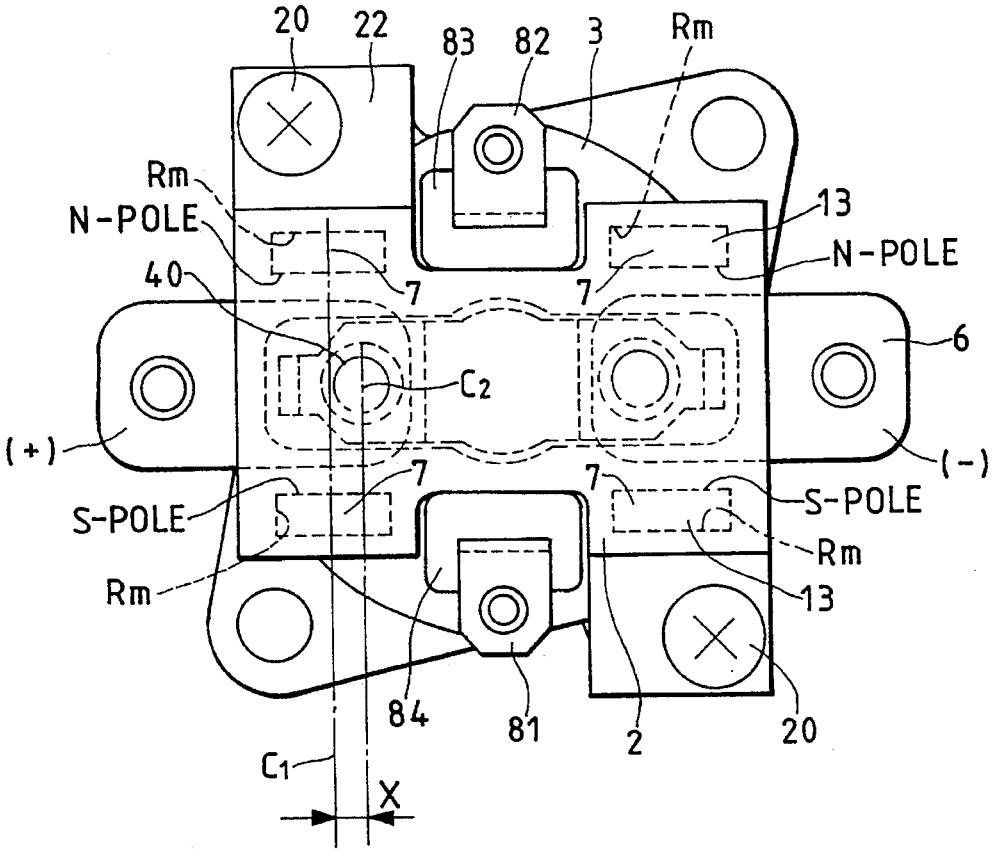
FIG. 2 is a plane view which illustrates the electromagnetic relay of FIG. 1.

The switching assembly S includes a resin-made box-like housing 2 and a resin-made annular insulator 3. The housing 2 engages through its bottom the insulator 3 so that an opening of the housing is shielded by the insulator 3 except a central portion thereof. The housing 2 and the insulator 3 are, as shown in FIG. 2, fixed on the plate 14 using screws 20.

The housing 2 has formed therein a box-like working chamber R into which the insulating bush 18 of the solenoid assembly 1 is inserted along the center line of the relay 100. The housing 2 also has a cylindrical stopper 21 extending downward from a central portion of an inner wall. Arranged between the stopper 21 and the insulating bush 18 is a movable contact retainer 4 which is urged against the stopper 21 by the return spring 16 through the plunger 17 and the insulating bush 18.

The movable contact retainer 4 is formed with a strip member made of a good conductive material, and oriented horizontally, as viewed in FIG. 1. A pair of movable contacts 40 is mounted on a bottom surface of the movable contact retainer 4 at a given interval away from each other. The contact retainer 4 also has both end portions curved upward with a preselected curvature to form arc runners 41. A coil spring 5 is wound around the stopper 21 to bias the movable contact retainer 4 downward.

Formed in the upper surface of the insulator 3 exposed to the working chamber R is a pair of recessed portion elongated horizontally into which a pair of stationary contact retainers 6 is inserted partially in tight engagement therewith. Each of the stationary contact retainers 6 is made of a conductive strip member, and has mounted on its end a stationary contact 60 in vertical alignment with a corresponding one of the movable contacts 40 with a given air gap g (i.e., contact gap). An inner portion of the insulator 3, as shown in FIG. 1, projects toward the movable contacts 40, on which the end portions of the stationary contact retainers 6 bearing the stationary contacts 60 are placed. An outer portion of each of the stationary contact retainers 6 is bent to form an arc runner 61 extending horizontally.

The working chamber R includes contact chambers R1 and R2 and an axial bore chamber R3. The contact chambers R1 and R2 have disposed therein two contact pairs each composed of the movable contact 40 and the stationary contact 60. The axial bore chamber R3 receives therein the insulating bush 18. Each of the contact chambers R1 and R2 forms recessed portions Rm arranged, as can be seen in FIG. 2, opposite each other across the movable contact retainer 4 and the fixed contact retainers 6. Each of the recessed portion Rm opens downward to define a permanent magnet storage cavity within which a permanent magnet 7 is disposed tightly. The permanent magnets 7 function as an arc-extinguishing means.

The permanent magnets 7 are formed with a disc member, and so arranged across the contact gap as to orient their poles magnetically opposite each other. Specifically, the north poles of the upper side magnets 13, as viewed in FIG. 2, face the south poles of the lower side magnets 13.

The permanent magnets 7 are also physically oriented so that the center line $C_1$ of each of the permanent magnets 7, as shown in FIGS. 1 and 2, may be offset by a given interval X from the center line $C_2$ of each of the movable contacts 40 and the stationary contacts 60 outward, or toward the arc runners 41 and 61. In this comparative example, the center line $C_1$ of each of the permanent magnets 7 extends through the outermost portion of the periphery of each of the movable contacts 40.

Terminals 81 and 82, as shown in FIG. 2, are connected to both ends of the coil 13 for power supply, and supported by terminal supports 83 and 84 which extend upward from the bobbin 12 through bores formed in the insulator 3.

In operation, the supply of dc current to the coil 13 causes a stationary magnetic circuit composed of the yoke 11, the plate 14, and the stationary core 15 to be magnetized, thereby bringing the plunger 17 into engagement with the stationary core 15 against a compression force of the return spring 16. The movement of the plunger 17 causes the movable contact retainer 4 to be pulled downward with the aid of a spring force of the coil spring 5 so that the movable contacts 40 engage the stationary contacts 60 for establishing electrical communication between the stationary contact retainers 6 and the movable contact retainer 4.

When the current is withdrawn from the coil 13, it will cause the magnetization of the stationary magnetic circuit to disappear, releasing the return spring 16 to lift the plunger 17 upward. This causes the movable contact retainer 4 to be displaced away from the stationary contact retainers 6 against a compression force of the coil spring 5, thereby bringing the movable contacts 40 into disengagement from the stationary contacts 60 to break both the stationary contact retainers 6 electrically. The upward movement of the: movable contact retainer 4 is restricted by the stopper 21 to maintain the contact gap constant.

When the movable contacts 40 disengage from the stationary contacts 60, electric arcs will be generated therebetween. These arcs are then biased outward in a lateral direction, as viewed in FIG. 1, by the activities of Lorentz forces produced by magnetic fields of both the permanent magnets 7. Since intervals between the arc runners 41 and 61 of the movable contact retainer 4 and the stationary contact retainers 6 formed outside the contact pairs 40 and 60 increase gradually in outward directions, spaces in which arc currents, or discharges are generated are increased, thereby reducing the density of ions per unit space so that the arcs are extinguished quickly according to increases in the intervals between the arc runners 41 and 61 caused by the disengagement of the movable contact retainer 4 (see FIG. 4).

Additionally, the centers of the permanent magnets 7 are, as discussed above, shifted by the interval X from the centers of the contact pairs 40 and 60 toward the arc runners 41 and 61. This arrangement provides for strong magnetic fields acting on the arcs. In this comparative example, each of the permanent magnets 7 is so arranged that the center line $C_1$ may intersect a line extending through an intermediate point between the outer end of each of the arc runners 41 and the inner end of each of the movable contacts 40.

The assembling operation of the above electromagnetic relay 100 will be discussed below.

First, the coil 13 wound around the bobbin 12 is disposed within the yoke 11 mounted on the bracket 10. The stationary core 15, the return spring 16, and the plunger 17 with the insulating bush 18 are disposed, in sequence, inserted into the bobbin 12 and then the plate 14 is staked on the yoke 11.

Figure 3:
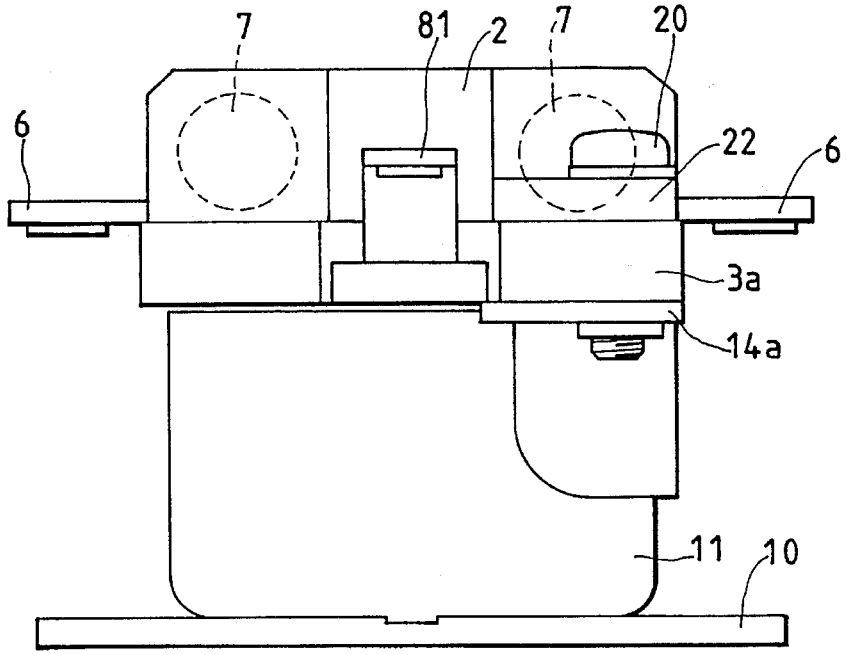
FIG. 3 is a partially vertical sectional view which illustrates the electromagnetic relay of FIG. 1.
Figure 4:
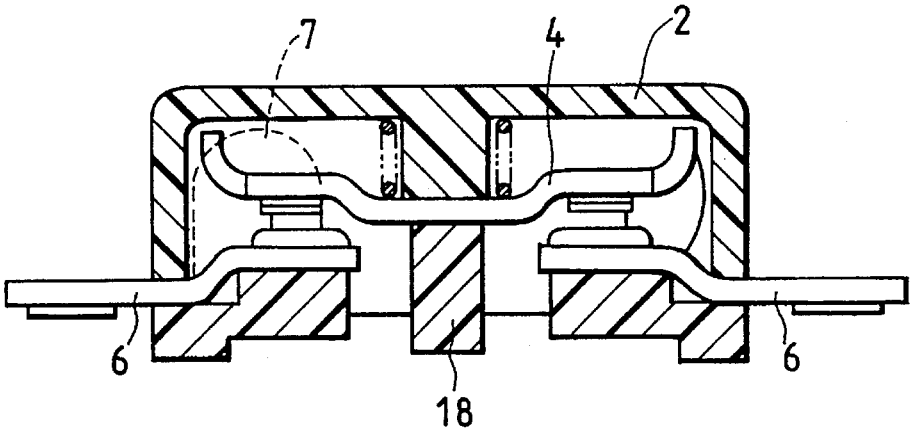
FIG. 4 is a partially sectional view which illustrates a contact retainer structure of the electromagnetic relay of FIG. 1.

Subsequently, the insulator 3 having disposed thereon the stationary contact retainers 6, the movable contact retainer 4, and the coil spring 5 are mounted, in sequence, on the yoke 11, and then covered by the housing 2 having therein the permanent magnets 7. Brackets 22 of the housing 2 and outer flange portions **3*a* of the insulator 3 are, as shown in FIG. 3, fixed on outer flange portions 14*a* of the plate 14 using screws 20** to complete the assembly.

The inner ends of the stationary contact retainers 6, as can be seen in FIG. 1, project inside the opening of the insulator 3 for preventing the plunger 17 from being dislodged out of the opening of the insulator 3. This requires the stationary contact retainers 6 to be assembled after installation of the plunger 17. Thus, if the movable contact retainer 4 is inseparably secured on the plunger 17 to form a plunger assembly, as found in some conventional structures, it is necessary to incorporate the stationary contact retainers 6 into the housing 2 from lateral directions, respectively.

In this comparative example, the movable contact retainer 4 is separate from the insulating bush 18 attached to the plunger 17 and detachably mounted thereon. Thus, the stationary contact retainers 6 may be fitted downward into the open grooves of the insulator 3 after installation of the plunger 17. Alternatively, the stationary contact retainers 6 premounted on the insulator 3 may be assembled after installation of the plunger 17. The movable contact retainer 4 may subsequently be mounted on the insulating bush 18. This assembling process provides for ease of assembling operations, and is suitable for automatic assembly.

Figure 5:
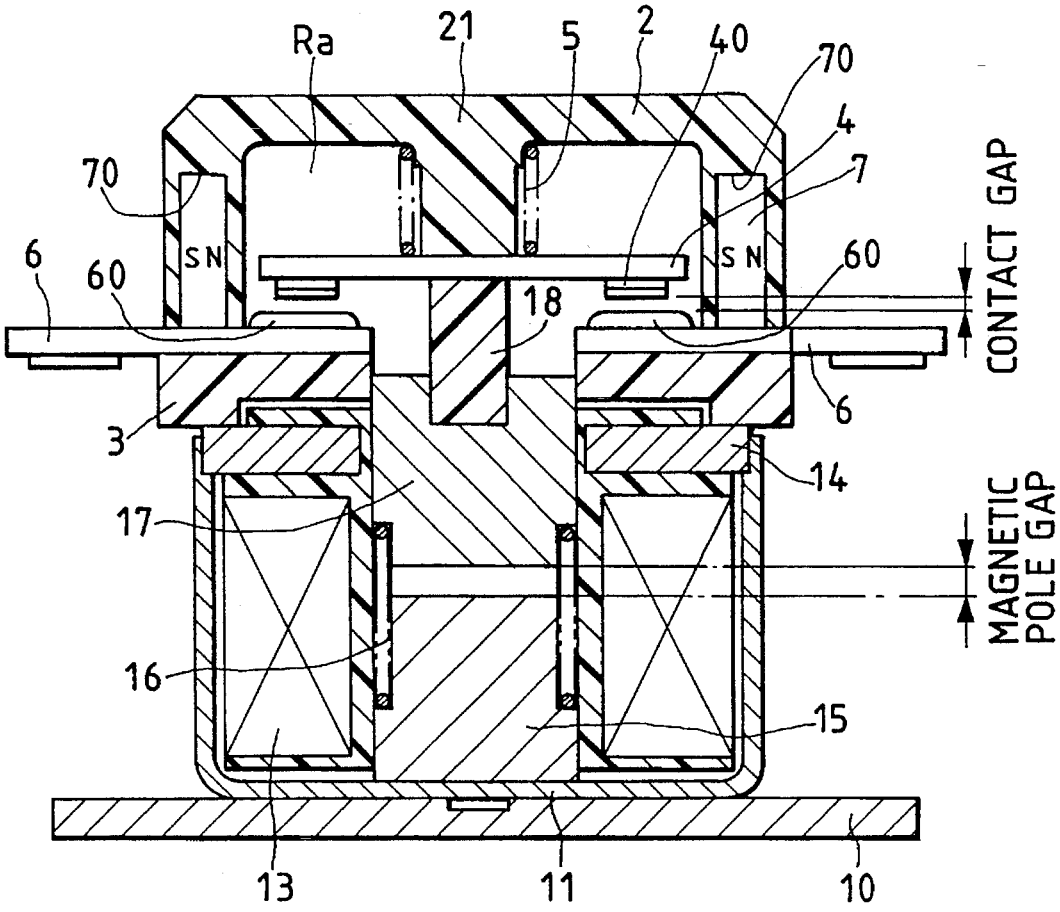
FIG. 5 is a cross sectional view which shows an electromagnetic relay according to the present invention.
Figure 6:
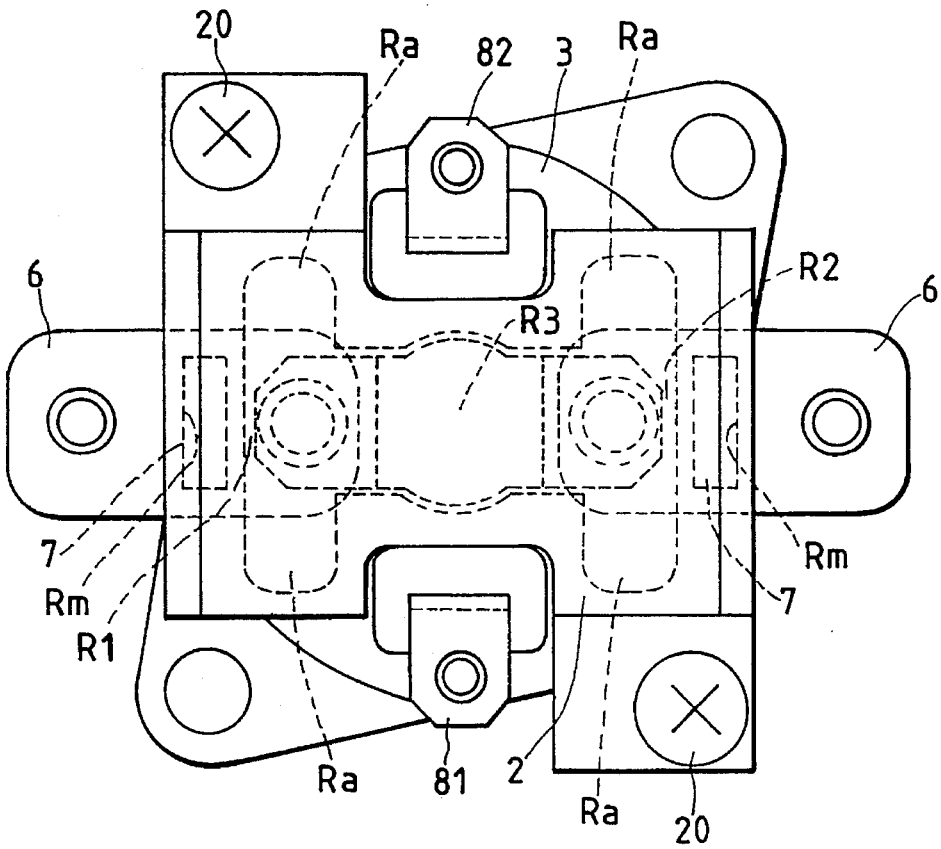
FIG. 6 is a plane view which illustrates an electromagnetic relay of the invention.

Referring to FIGS. 5 and 6, there is shown a plunger type electromagnetic relay 200 according to the present invention.

The electromagnetic relay 200 has substantially the same construction as that of the above discussed electromagnetic relay 100 except for an arrangement as discussed below and explanation of the same construction in detail will be omitted here.

The electromagnetic relay 200 includes a pair of permanent magnets 7 which are disposed, respectively, within cavities 70 formed in a side wall of a housing 2 which are diametrically opposed to each other across a movable contact retainer 4 so that the permanent magnets 7 may be arranged outside a pair of movable contacts 40 and a pair of stationary contacts 60 mounted on stationary contact retainers 6. The permanent magnets 7 are so oriented that opposite magnetic poles face each other. Specifically, the north pole of the left-hand side magnet 7, as viewed in the drawings, is arranged opposite the south pole of the right-hand side magnet 7 along the direction of current flow through the movable contact retainer 4. Thus, the magnetic flux produced between the north and south poles of the permanent magnets 7 acts on both contact gaps between the movable contacts 4 and the stationary contacts 60, and the magnetic flux produced by each of the permanent magnets 7 itself is also exerted on the adjacent contact gap. This will produce an arc-extinguishing magnetic flux stronger than that produced by an arrangement having permanent magnets, only one for each contact gap. With these arrangements, electric arcs, or discharges travel from the contact pairs 40 and 60 in a horizontal direction. Thus, if the arcs are biased backward by some back current, the surface of an insulating bush 18 will not be deteriorated. Particularly, an electric automobile is commonly driven by a motor and charged for regeneration. During the regenerative charging, the current flows in a reverse direction to that during the traveling of the automobile. However, with the above mentioned arrangements of the electromagnetic relay 200, arcs are drawn somewhere in arc chambers or spaces Ra defined, as shown in FIG. 6, across a stopper 21 in the housing 2, even if the current flows through the relay 200 in any directions. This prevents movable parts of the relay 200 from being welded undesirably. The arc spaces Ra are so formed as to extend over the contact pairs in a width direction of the movable and stationary contact retainers 4 and 6.

Figure 7:
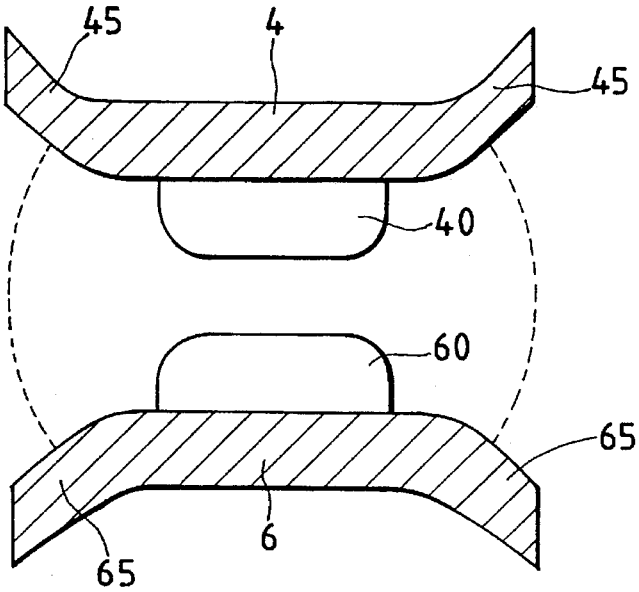
FIG. 7 is an enlarged view which shows a contact retainer structure.

The movable contact retainer 4 and the stationary contact retainers 6 may have, as shown in FIG. 7, arc runners 45 and 65. FIG. 7 illustrates cross sections of the movable and stationary contact retainers 4 and 6 in width directions thereof. The arc runners 45 and 65 are formed by bending both side portions of the movable and stationary contact retainers 4 and 6 outward from the movable and stationary contacts 40 and 60 in opposite directions away from each other. This arrangement enhances the arc-extinguishing ability. The symmetrical geometry of the arc runners 45 of the movable contact retainer 4 also serve to keep a dynamic balance of the movable contact retainer 4 during operation of the relay.

Figure 8:
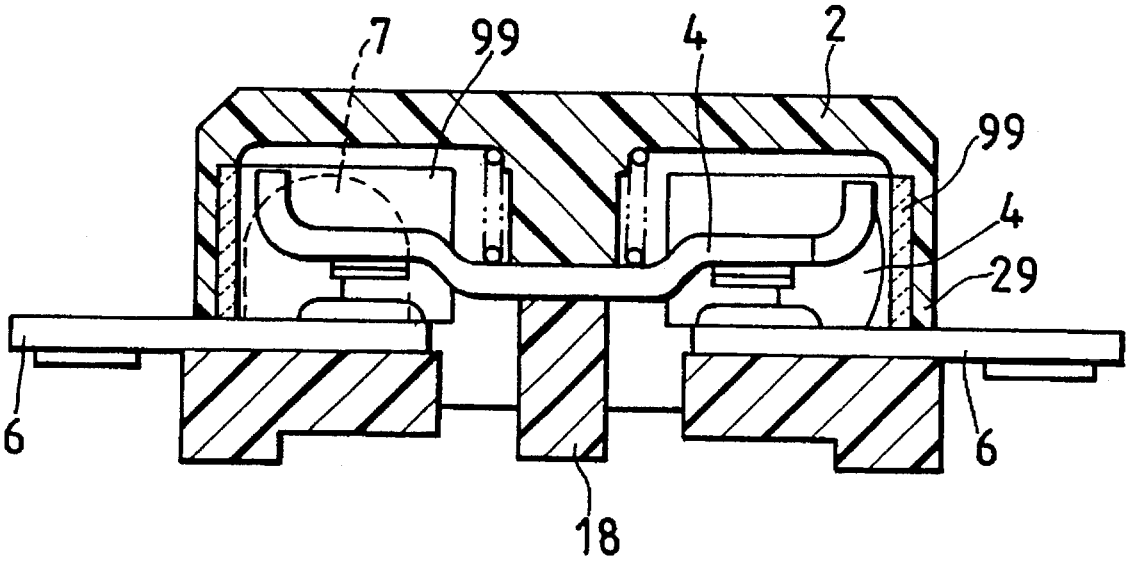
FIG. 8 is a partially cross sectional view which shows a modification of the electromagnetic relay shown in FIG. 5.

FIG. 8 shows a modification of the electromagnetic relay 100 of the comparative example as described above with reference to FIGS. 1 to 4, and is different from the relay 100 only in an arrangement as discussed below. Explanation of the same arrangements in detail will be omitted here.

The shown electromagnetic relay 300 has arc-resistant plates 99 disposed within plate storage cavities 29 in tight engagement therewith. The arc-resistant plates 99 are made of a ceramic material. The plate storage cavities 29 are so formed in an inner wall of a housing 2 as to orient inner surfaces of the arc-resistant plates 99 around the movable contact retainer 4 (i.e., a contact gap). The platte storage cavities 29 are opened downward, as viewed in the drawing, for facilitating easy removal from a die after casting.

With the above arrangements, arcs biased by the permanent magnets 7 in a direction perpendicular to the drawing collide against the arc-resistant plates 99 so that they are cooled effectively. This prevents the deterioration, carbonization, and reduction in insulation of the resin-made housing 2.

The above discussed arrangements may be used with the electromagnetic relay 200 of the first embodiment, as shown in FIGS. 5 and 6. In this case, it is preferable that the plate storage cavities 29 be formed in an inner wall of the housing 2 around the arc chambers Ra.

While the present invention has been disclosed in terms of the preferred embodiment in order to facilitate better understanding thereof it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An electromagnetic relay comprising:

a housing;

a movable contact retainer having disposed thereon a pair of movable contacts;

a stationary contact retainer disposed within said housing, having disposed thereon a pair of stationary contacts at a given interval away from the movable contacts;

a solenoid assembly connected to said housing, said solenoid assembly moving a plunger connected to said movable contact retainer for selectively driving said movable contact: retainer to bring the movable contacts into engagement with and disengagement from the stationary contacts; and a pair of permanent magnets disposed within said housing diametrically opposite each other across the pair of movable contacts, said pair of permanent magnets having magnetic poles oriented opposite each other.

2. An electromagnetic relay as set forth in claim 1, wherein the solenoid assembly includes a magnetic coil wound in the vicinity of an outer peripheral surface of the plunger and a cylindrical yoke, receiving therein the magnetic coil, constituting part of a stationary magnetic circuit of the solenoid assembly.

3. An electromagnetic relay as set forth in claim 1, further including a working chamber in which said movable contact retainer is disposed, said working chamber being defined within said housing and having arc spaces that are defined above said solenoid assembly to which electric arcs produced between the movable and stationary contacts are biased by magnetic forces of permanent magnets, respectively.

4. An electromagnetic relay as set forth in claim 3, wherein said movable contact retainer includes a strip member for retaining the movable contacts at a given distance away from each other relative to a lengthwise direction of the movable contact retainer, each of the arc spaces being defined to extend over a contact gap in a widthwise direction relative to the movable contact retainer.

5. An electromagnetic relay as set forth in claim 1, wherein said housing is formed with a resin material in a cup-shape and has permanent magnet storage cavities formed in an end surface of a side wall thereof.

6. An electromagnetic relay as set forth in claim 1, wherein said movable contact retainer includes a strip member for retaining the movable contacts at a given distance away from each other relative to a lengthwise direction of the movable contact retainer, said movable contact retainer having side portions curved outward from the movable contacts in a direction away from said stationary contact retainer.

7. An electromagnetic relay as set forth in claim 6, wherein said curved side portions are geometrically oriented in symmetrical form.

8. An electromagnetic relay as set forth in claim 1, wherein said stationary contact retainer includes a strip member for retaining the stationary contacts at a given distance away from each other relative to a lengthwise direction of the stationary contact retainer, said stationary contact retainer having side portions curved outward from the stationary contacts in a direction away from said movable contact retainer.

9. An electromagnetic relay as set forth in claim 8, wherein said curved side portions are geometrically oriented in symmetrical form.

10. An electromagnetic relay as set forth in claim 1, further comprising an arc-resistant member arranged to receive an electric arc, produced in a contact gap between the movable and stationary contacts, biased by magnetic forces of said permanent magnets.

11. An electromagnetic relay as set forth in claim 10, wherein said arc-resistant member is made of a ceramic material.

12. An electromagnetic relay comprising:

a housing;

a movable contact retainer disposed within the working chamber of said housing, said movable contact retainer having disposed thereon a pair of movable contacts;

a stationary contact retainer disposed within said housing, having disposed thereon a pair of stationary contacts at a given interval away from the movable contacts;

a solenoid assembly connected to said housing, said solenoid assembly moving a plunger connected to said movable contact retainer for selectively driving said movable contact retainer to bring the movable contacts intoengagement with and disengagement from the stationary contacts; and a pair of permanent magnets disposed within said housing diametrically opposite each other across the pair of movable contacts, said pair of permanent magnets having magnetic poles oriented opposite each other.

13. An electromagnetic relay as set forth in claim 12, wherein the solenoid assembly includes a magnetic coil wound in the vicinity of an outer peripheral surface of the plunger and a cylindrical yoke, receiving therein the magnetic coil constituting part of a stationary magnetic circuit of the solenoid assembly.

14. An electromagnetic relay as set forth in claim 13, further including a working chamber in which said movable contact retainer is disposed, said working chamber being defined within said housing and having arc spaces that are defined above said solenoid assembly to which electric arcs produced between the movable and stationary contacts are biased by magnetic forces of said permanent magnets, respectively.

15. An electromagnetic relay as set forth in claim 14, wherein said movable contact retainer includes a strip member for retaining the movable contacts at a given distance away from teach other relative to a lengthwise direction of the movable contact retainer, each of the arc spaces being defined to extend over a contact gap in a widthwise direction relative to the movable contact retainer.

16. An electromagnetic relay as set forth in claim 12, wherein said housing is formed with a resin material in cup-shape and has permanent magnet storage cavities formed in an end surface of a side wall thereof.

17. An electromagnetic relay as set forth in claim 12, wherein said movable contact retainer includes a strip member for retaining the movable contacts at a given distance away from each other relative to a lengthwise direction of the movable contact retainer, said movable contact retainer having side portions curved outward from the movable contacts in a direction away from said stationary contact retainer.

18. An electromagnetic relay as set forth in claim 17, wherein said curved side portions are geometrically oriented in symmetrical form.

19. An electromagnetic relay as set forth in claim 12, wherein said stationary contact retainer includes a strip member for retaining the stationary contacts at a given distance away from each other relative to a lengthwise direction, said stationary contact retainer having side portions curved outward from the stationary contacts in a direction away from said movable contact retainer.

20. An electromagnetic relay as set forth in claim 19, wherein said curved side portions are geometrically oriented in symmetrical form.

21. An electromagnetic relay as set forth in claim 12, further comprising an arc-resistant member arranged to receive an electric arc, produced in a contact gap between the movable and stationary contacts, biased by magnetic forces of said permanent magnets.

22. An electromagnetic relay as set forth in claim 21, wherein said arc-resistant member is made of a ceramic material.

23. An electromagnetic relay comprising:

a relay housing;

a movable contact retainer having a pair of movable contacts disposed thereon;

a stationary contact retainer having a pair of stationary contacts disposed thereon, a given contact gap being defined between itself and the movable contacts;

magnetic driving means for selectively driving said movable contact retainer to bring the movable contacts into engagement with and disengagement from the stationary contacts;

pairs of permanent magnets disposed within said relay housing, each pair being arranged to have magnetic poles oriented opposite each other across one of contact pairs composed of the movable contacts and the stationary contacts for biasing an electric arc produced in the contact gap in a given direction; and an arc-resistant member provided in said relay housing for cooling an electric arc, produced in the contact gap, biased by said permanent magnets.

24. An electromagnetic relay as set forth in claim 23, wherein said arc-resistant member is made of a ceramic material and secured on am inner wall of said relay housing for receiving the electric arc biased by said permanent magnets.

25. An electromagnetic relay as set forth in claim 1, further including a working chamber in which said movable contact retainer is disposed being defined within said housing, said working chamber and said pair of permanent magnets being disposed outside the working chamber.

26. An electromagnetic relay as set forth in claim 3, wherein said movable contact retainer and said stationary contact retainer are each formed with a strip member, said strip members being respectively arranged adjacent each other in a direction of movement of the movable contacts, and the arc spaces being defined across the strip members of said movable contact retainer and said stationary contact retainer in a widthwise direction of the strip members.

27. An electromagnetic relay as set forth in claim 16, wherein said movable contact retainer and said stationary contact retainer are each formed with a strip member, said strip members being arranged adjacent each other in a direction of movement of the movable contacts, and the arc spaces being defined across the strip members of said movable contact retainer and said stationary contact retainer in a widthwise direction of the strip members.

* * * * *